US008145114B2

(12) United States Patent
Tutt et al.

(10) Patent No.: US 8,145,114 B2
(45) Date of Patent: Mar. 27, 2012

(54) DIGITAL MANUFACTURE OF A MICROFLUIDIC DEVICE

(75) Inventors: Lee W. Tutt, Webster, NY (US); Donna P. Suchy, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/608,040

(22) Filed: Oct. 29, 2009

(65) Prior Publication Data

US 2011/0103838 A1 May 5, 2011

(51) Int. Cl.
*G03G 15/20* (2006.01)

(52) U.S. Cl. ..... 399/342; 399/222

(58) Field of Classification Search ..... 399/342, 399/341, 336, 222, 223, 252
See application file for complete search history.

(56) References Cited

U.S. PATENT DOCUMENTS

| | | | | |
|---|---|---|---|---|
| 4,965,131 | A | 10/1990 | Nair et al. | 430/110.2 |
| 5,778,295 | A | 7/1998 | Chen et al. | 399/329 |
| 6,086,825 | A | 7/2000 | Sundberg et al. | 422/100 |
| 6,567,641 | B1 | 5/2003 | Aslam et al. | 399/330 |
| 6,896,360 | B2 | 5/2005 | Cox et al. | 347/65 |
| 7,553,393 | B2 | 6/2009 | Derand et al. | 156/292 |
| 7,557,232 | B2 | 7/2009 | Lin et al. | 556/449 |
| 2008/0159786 | A1 | 7/2008 | Tombs et al. | 399/222 |
| 2009/0142100 | A1 | 6/2009 | Suchy et al. | 399/223 |

FOREIGN PATENT DOCUMENTS

| | | |
|---|---|---|
| EP | 0765763 | 4/1997 |
| WO | WO88/10193 | 12/1988 |
| WO | WO98/54004 | 12/1998 |
| WO | WO2008-082648 | 7/2008 |
| WO | WO2009/011773 | 1/2009 |

*Primary Examiner* — Sophia S Chen
(74) *Attorney, Agent, or Firm* — Donna P. Suchy

(57) ABSTRACT

In view of the above, this invention is directed to printing methods including electrographic printing wherein toner and/or laminates form one or more multi-channeled layers, with a particular pattern. The multi-channeled layers are printed, such as by electrographic techniques, using the steps of forming a desired image on a receiver member and incorporating channels of toner that form a microfluidic item. In the microfluidic items the channels act as interconnects to transfer fluids between incorporated micro-devices such as pumps, devices, and sensors. The channels can also be designed to act as splitters ports, reservoirs, filters, and separators to allow a variety of specialty micro-devices to be developed with the printer.

22 Claims, 9 Drawing Sheets

DIGITAL MANUFACTURE OF A MICROFLUIDIC DEVICE

CROSS REFERENCE TO RELATED APPLICATIONS

This application relates to commonly assigned, copending U.S. application Ser. No. 12/608,047, filed Oct. 29, 2009, entitled: "DIGITAL MANUFACTURE OF AN GAS OR LIQUID SEPARATION DEVICE."

FIELD OF THE INVENTION

The present invention relates electrographic printing and more particularly to printing a three-dimensional microfluidic device.

BACKGROUND OF THE INVENTION

One common method for printing images on a receiver member is referred to as electrography. In this method, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, resin particles are given a charge, substantially opposite the charge pattern on the dielectric member and brought into the vicinity of the dielectric member so as to be attracted to the image-wise charge pattern to develop such pattern into a patterned image.

Thereafter, a suitable receiver member (e.g., a cut sheet of plain bond paper) is brought into juxtaposition with the marking particle developed image-wise charge pattern on the dielectric member. A suitable electric field is applied to transfer the marking particles to the receiver member in the image-wise pattern to form the desired print image on the receiver member. The receiver member is then removed from its operative association with the dielectric member and the marking particle print image is permanently fixed to the receiver member typically using heat, and/or pressure and heat. Multiple layers or marking materials can be overlaid on one receiver, for example, layers of different color particles can be overlaid on one receiver member to form a layer print image on the receiver member after fixing.

In the earlier days of electrographic printing it was desirable to minimize channel formation during fusing. Under most circumstances, channels are considered an objectionable artifact in the print image. In order to improve image quality, and still produce channels a new method of printing has been formulated in U.S. Publication 2009/0142100. In that invention one or more multi-channeled layers are formed using electrographic techniques. There, use of layered printing, includes possible raised images to create channels capable of allowing movement of a fluid, such as an ink or dielectric, to provide a printed article with, among other advantages, a variety of security features on a digitally printed document.

Microfluidic structures are used for transporting fluid materials around in micro devices. As such there is a need to make routing structure for the fluids. In U.S. Pat. No. 7,216,671 elastomeric layers are made from mold and then stacked. The recesses of the stack allow channels be formed and allow movement of fluids between layers as interconnections. In this invention separate molds are necessary for every layer and a change necessitates new molds be created.

For microfluidic devices to be useful as more than simply as a transport mechanism, it must include other devices. Some of the devices which are commonly incorporated are pumps, valves and mixing regions. In U.S. Pat. Nos. 7,040,338, and 7,169,314 pumps and valves are incorporated. In these patents the separate molds form thin barrier regions in some channels which can be deformed. These barriers can be deformed by the use of pressure. When appropriately shaped, this deformation can act as a valve, preventing the flow of liquid when the barrier is pushed into another channel. If there is an asymmetry in the channel the deformed barrier moves into, then the action can move fluid around. In this case through the use of a periodic deformation, a fluid pump is formed.

Another method of forming a pump in a microfluidic device is illustrated in U.S. Pat. No. 7,540,469. In this method two electrodes are outside the channel. When a voltage is applied between the electrodes the channel is deformed and the pump action occurs. If the voltage is sufficiently high and the channel sufficiently narrow, the deformation can close off the channel. In this case the device is operating as a valve. This microelectromechanical device (MEM) device is integrated into a microfluidic channeled device pre or post-patterned.

Many other devices such as column chromatography column see copending application U.S. application Ser. No. 12/608,047, sensors for detecting fluids or analytes, as well as actuators may be desired. The portions that are in common are the channels which can consist of normal channels as well associated topologic shapes such as splitters, combiners, and mixers. They may even include reservoirs for hold small quantities of fluids until desired.

It is therefore needed a process for making these channels and their associated topologic shapes in a cost efficient and digitally modifiable manner. Some processes have been disclosed such as U.S. Pat. No. 7,095,484 which address this issue. In this patent a micro-mirror device exposes photoresist in a 3 dimensional manner. Subsequent development to generate with an appropriate developer generates the required topologies. It is desired to not need to use wet developers with their associated waste.

It is also necessary to cover layers with a transparent barrier to encapsulate channels as they are built or as a final layer. One way which these barriers can be applied is through lamination of a cover sheet. Microfluidics with laminates is known, as discussed in U.S. Pat. No. 7,553,393. In that patent there is no discussion of the method of manufacture of the channels. The inventors assume one has already generated it and present a lamination method.

There is therefore a need for a process which can generate channels and openings which can be subsequently be encapsulated or top sealed to for fluid paths. The method needs to be both cheap and alignable between layers and most importantly easily reconfigurable to new design. This invention solves these problems.

SUMMARY OF THE INVENTION

In view of the above, this invention is directed to electrographic printing wherein toner and/or laminates form one or more multi-channeled layers, with a particular pattern, which can be printed by electrographic techniques. Such electrographic printing includes the steps of forming a desired image, electrographically, on a receiver member and incorporating channels that are embedded into the design.

These channels have act as interconnects to transfer fluids between pumps, devices, and sensors. They can also be designed as splitters ports, reservoirs, filters, and separators.

The invention, and its objects and advantages, will become more apparent in the detailed description presented below.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures.

In the detailed description of the preferred embodiment of the invention presented below, reference is made to the accompanying drawings, in which.

DETAILED DESCRIPTION OF THE INVENTION

Figure 1:
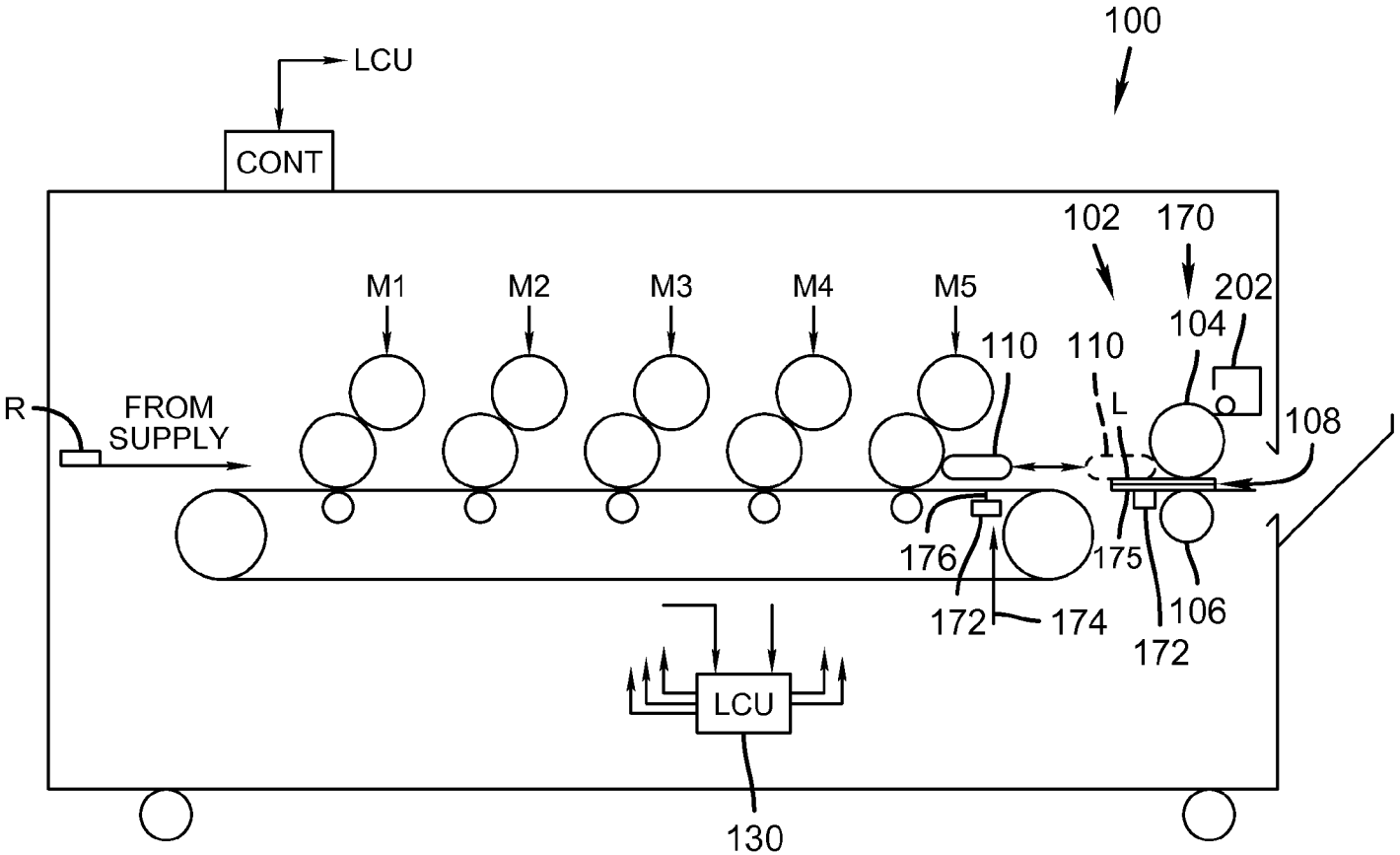
FIG. 1 is a schematic side elevational view, in cross section, of a typical electrographic reproduction apparatus suitable for use with this invention.
Figure 2:
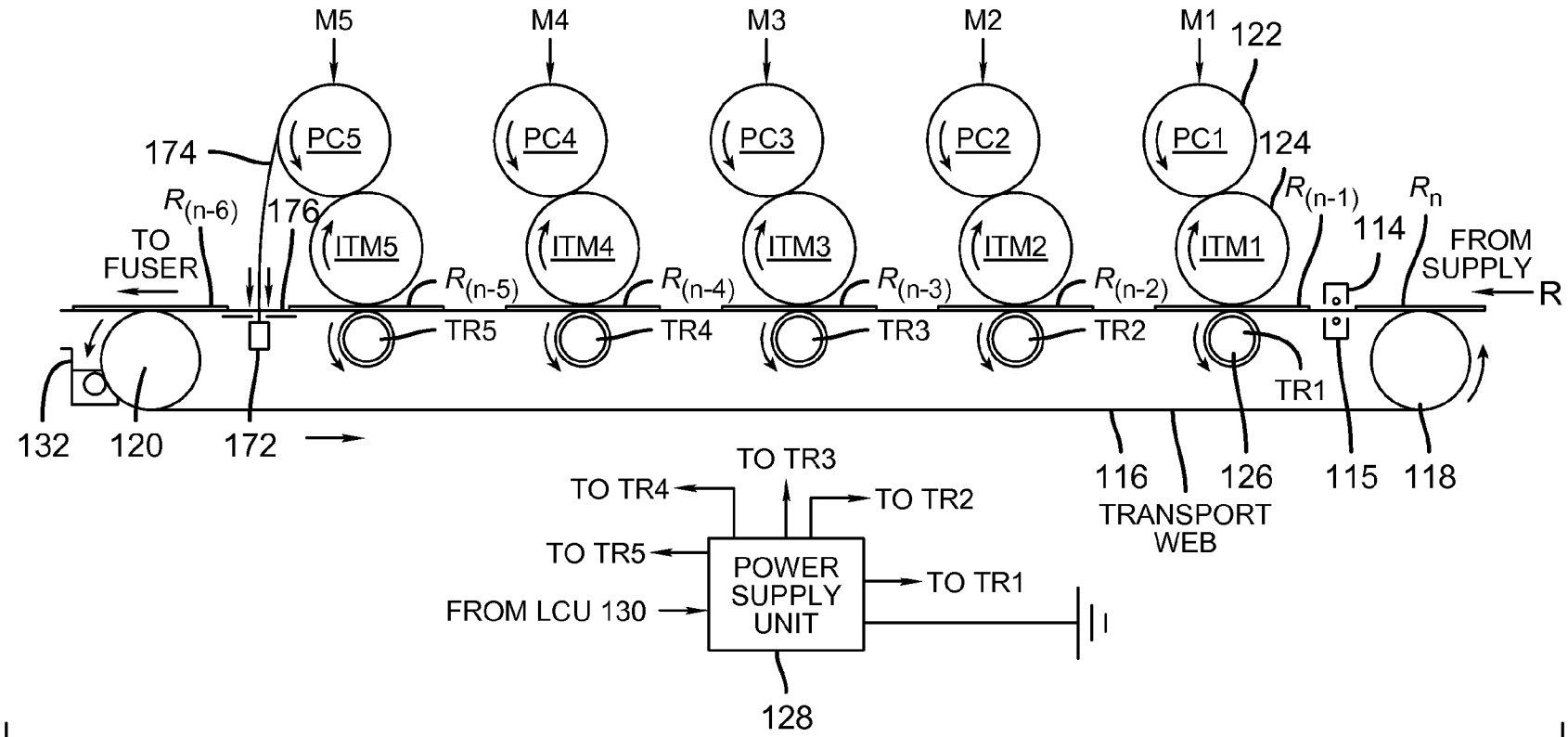
FIG. 2 is a schematic side elevational view, in cross section, of the reprographic image-producing portion of the electrographic reproduction apparatus of FIG. 1, on an enlarged scale.

Referring now to the accompanying drawings, FIGS. 1 and 2 are side elevational views schematically showing portions of a typical electrographic print engine or printer apparatus suitable for printing of multi-channel layered prints. One embodiment of the invention involves printing using an electrophotographic engine having five sets of single layer image producing or printing stations or modules arranged in tandem and an optional finishing assembly. The invention contemplates that more or less than five stations may be combined to deposit toner on a single receiver member, or may include other typical electrographic writers, printer apparatus, or other finishing devices.

An electrographic printer apparatus 100 has a number of tandemly arranged electrostatographic image forming printing modules M1, M2, M3, M4, and M5 and a finishing assembly 102. Additional modules may be provided.

Each of the printing modules generates a single-layer toner image for transfer to a receiver member successively moved through the modules. The finishing assembly has a fuser roller 104 and an opposing pressure roller 106 that form a fusing nip 108 there between. The finishing assembly 102 can also include a laminate application device 110. A receiver member R, during a single pass through the five modules, can have transferred, in registration, up to five single toner images to form a pentalayer image. As used herein, the term pentalayer implies that in an image formed on a receiver member combinations of subsets of the five layers are combined to form other layers on the receiver member at various locations on the receiver member, and that all five layers participate to form multiple layers in at least some of the subsets wherein each of the five layers may be combined with one or more of the other layers at a particular location on the receiver member to form a layer different than the specific layer toners combined at that location.

Receiver members (Rn-R(n−6), where n is the number of modules as shown in FIG. 2) are delivered from a paper supply unit (not shown) and transported through the printing modules M1-M5 in a direction indicated in FIG. 2 as R. The receiver members are adhered (e.g., preferably electrostatically via coupled corona tack-down chargers 114, 115) to an endless transport web 116 entrained and driven about rollers 118, 120. Each of the printing modules M1-M5 similarly includes a photoconductive imaging roller, an intermediate transfer member roller, and a transfer backup roller. Thus in printing module M1, a toner separation image can be created on the photoconductive imaging roller PC1 (122), transferred to intermediate transfer member roller ITM 1 (124), and transferred again to a receiver member moving through a transfer station, which includes ITM1 forming a pressure nip with a transfer backup roller TR1 (126).

Similarly, printing modules M2, M3, M4, and M5 include, respectively: PC2, ITM2, TR2; PC3, ITM3, TR3; PC4, ITM4, TR4; and PC5, ITM5, TR5. A receiver member, Rn, arriving from the supply, is shown passing over roller 118 for subsequent entry into the transfer station of the first printing module, M1, in which the preceding receiver member R(n−i) is shown. Similarly, receiver members (R(n−2) R(n−3), R(n−4), and R(n−5) are shown moving respectively through the transfer stations of printing modules M2, M3, M4, and M5. An unfused image formed on receiver member R(n−6) is moving, as shown, towards one or more finishing assemblies 102 including a fuser, such as those of well known construction, and/or other finishing assemblies in parallel or in series that includes, preferably a lamination device 110 (shown in FIG. 1). Alternatively the lamination device 110 can be included in conjunction to one of the print modules, Mn, which in one embodiment is the fifth module M5.

A power supply unit 128 provides individual transfer currents to the transfer backup rollers TR1, TR2, TR3, TR4, and TR5 respectively. A logic and control unit 130 (FIG. 1) in response to signals from various sensors associated with the electrophotographic printer apparatus 100 provides timing and control signals to the respective components to provide control of the various components and process control parameters of the apparatus in accordance with well understood and known employments. A cleaning station 132 for transport web 116 is also typically provided to allow continued reuse thereof.

Figure 3:
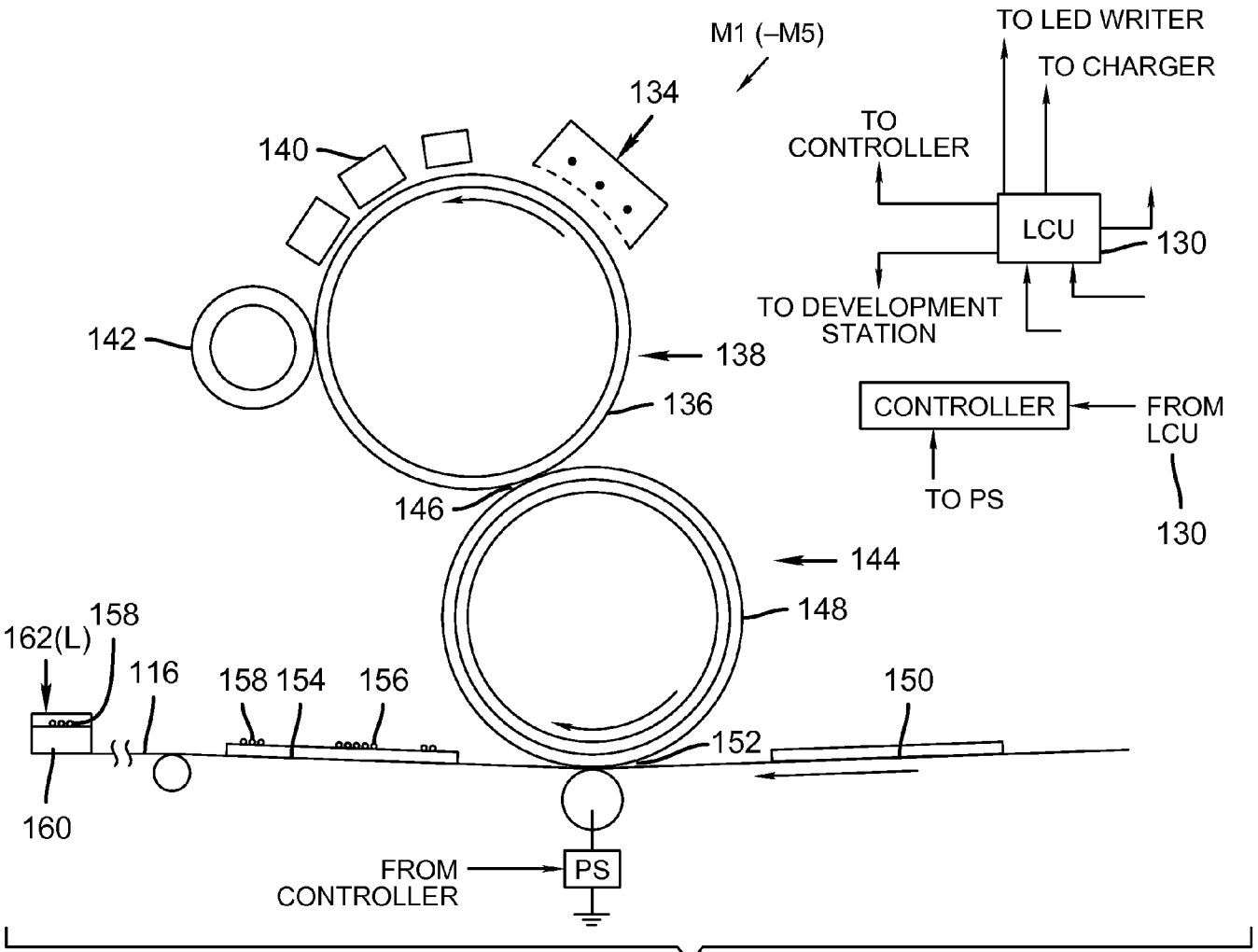
FIG. 3 is a schematic side elevational view, in cross section, of one printing module of the electrographic reproduction apparatus of FIG. 1, on an enlarged scale.

With reference to FIG. 3 wherein a representative printing module (e.g., M1 of M1-M5) is shown, each printing module of the electrographic printer apparatus 100 includes a plurality of electrographic imaging subsystems for producing one or more multilayered image or pattern. Included in each printing module is a primary charging subsystem 134 for uniformly electrostatically charging a surface 136 of a photoconductive imaging member (shown in the form of an imaging cylinder 138). An exposure subsystem 140 is provided for image-wise modulating the uniform electrostatic charge by exposing the photoconductive imaging member to form a latent electrostatic multi-layer (separation) image of the respective layers. A development station subsystem 142 serves for developing the image-wise exposed photoconductive imaging member. An intermediate transfer member 144 is provided for transferring the respective layer (separation) image from the photoconductive imaging member through a transfer nip 146 to the surface 148 of the intermediate transfer member 144 and from the intermediate transfer member 144 to a receiver member (receiver member 150 shown prior to entry into the transfer nip 152 and receiver member 154 shown subsequent to transfer of the multilayer (separation) image) which receives the respective (separation) images 156 in superposition to form a composite image 158 thereon.

Receiver member 160 shown subsequent to the transfer of an additional layer 162 that can be, in one embodiment, a laminate L.

The logic and control unit (LCU) 130 shown in FIG. 3 includes a microprocessor incorporating suitable look-up tables and control software, which is executable by the LCU 130. The control software is preferably stored in memory associated with the LCU 130. Sensors associated with the fusing assembly provide appropriate signals to the LCU 130. In response to sensors the LCU 130 issues command and control signals that adjust the heat and/or pressure within fusing nip 108 and otherwise generally nominalizes and/or optimizes the operating parameters of finishing assembly 102 (see FIG. 1) for printing multi-channeled layers in an image 158 on a substrate for as print.

Subsequent to transfer of the respective (separation) multilayered images, overlaid in registration, one from each of the respective printing modules M1-M5, the receiver member is advanced to a finishing assembly 102 (shown in FIG. 1) including one or more fusers 170 to optionally fuse the multilayer toner image to the receiver member resulting in a receiver product, also referred to as a final multi-channeled layer print 180. The finishing assembly 102 may include a sensor 172, an energy source 174 and one or more laminators 110. This can be used in conjunction to a registration reference 176 as well as other references that are used during deposition of each layer of toner, which is laid down relative to one or more registration references, such as a registration pattern.

The laminator 110 may be placed such that the laminate 162 is laid down prior to fusing or after the initial fusing. In one embodiment the apparatus of the invention uses a laminate in one or more layers.

The laminate, in one embodiment, can have a thickness that is greater then the largest toner particle and sufficient to prevent occlusion of the channel in the multi-channeled network. It is important that the laminate, also sometimes referred to as an adhesive film, can go onto of EP created channels without remelting the toner channels.

In one embodiment the material will have residual fusing oil on top, not all adhesive works well in an oiled environment. In that environment the laminate basically has oil absorption capability, so the lamination can be done uniformity on EP printed images. The idea here is 3-D channels (bottom and sides) can be created either via larger toner particle build up as a feature, or via stamping (with features) on thermal remeldable surface, such as coated surfaces.

Alternately, as discussed above the surface texture can be applied early in the printing process. An example is stamping which is essentially a 2-D process. In all the processes it is necessary to close off the channels. Any process that allows the top layer to follow the features below will collapse the channels created and will not work. One workable means is to apply a laminate without too much pressure/heat applied in the finishing steps to created channels in the 10 s micron range as described below.

Figure 4:
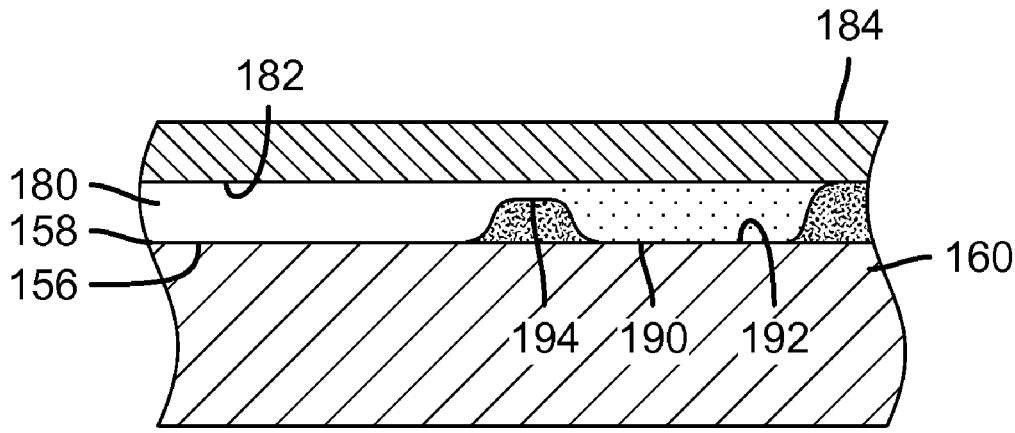
FIG. 4 is a schematic side elevational view, in cross section, of a print, produced by the invention.
Figure 5:
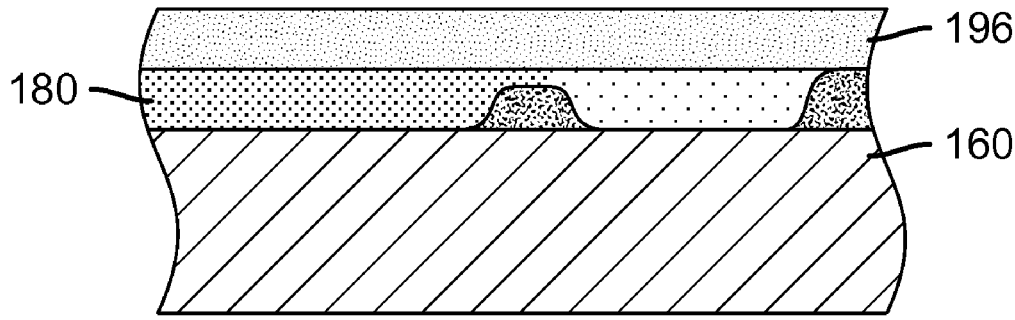
FIG. 5 is a schematic side elevational view, in cross section, of an activated print, having the predetermined multidimensional pattern formed in layers sufficient to form the final predetermined multi-channeled layers produced by the invention.

There are additional advantages to the use of laminates besides forming the top of a channeled network or array. These include improved abrasion resistance, additional types of gloss and increased abrasion and UV protection. It is necessary for the laminate, or an adhesive film used as a laminate, to have the structural integrity and thickness, as discussed above, to go onto electro photographic created channels without filling the channel when there are finishing actions, such as fusing, which is a remelting of the toner around the channels or the use of fusing oil on top. The laminate must work well in such an environment. One such laminate film is useful for this invention in an electro photographic digital printer and the laminate also has oil absorption capability, so the lamination can be applied uniformly to electro photographic printed images. One such laminate material is A laminate, such as Laminate GBC Layflat with a thickness of 37 um (micron) is useful for this application since the thickness is on the order of magnitude of the desired channel width of 10-50 um that are large enough to allow the toner of less then 8 um to flow. By controlling the laminate thickness the channel is not occluded by distended laminate in that would block the channel A multiple-channeled layer 180 includes one or more aerially placed channels 182 of variable width but consistent thickness formed on the receiver 160, as shown in FIG. 4. There may be layers of toner laid down between the receiver 160 and the multiple-channeled layer 180. The multiple-channeled layers 180, including the channels 182, are formed prior to the application of a laminate 184. The channel may also include a node 190 that is filled with a movable material 192, such as a fluid or pigment, as well as a narrowed section 194 formed as part of the channel 182. The multiple-channeled layer 180 is capped in one of a few ways including the application of the laminate 184 as described below or laid down as a top layer 196 as shown in FIG. 5, in one or more layers on top of the multiple-channeled layer 180.

The multiple-channeled layer 180 can be made using a larger particle or a chemically prepared toner (CDI) that is useful in building up as a feature as described in a co-pending application for Raised Print U.S. Publication 2008/0159786 hereby incorporated by reference.

The multiple-channeled layer 180 may also be formed as an embossed or varied surface via stamping (with features) on thermal remeldable surface, such as CDI coated surfaces. Two dimension embossing or stamping can create the desired structures needed before the laminate 184 is applied to the multiple-channeled layer 180. Alternatively the paper can have a surface that varies for other reasons that would contribute to the channels structure including a pretreated paper, a paper of higher clay content or having other surface additives that in certain circumstances and conditions achievable in the printing cycle would change the surface profile to form a channel or channels having a pattern, such as a variable and/or periodic pattern.

If the top layer 196 is to be laid down to close off the multiple-channeled layer 180 it involves more then just coating the channel structure with toner such as chemically prepared dry ink (CDI) or an inkjet. The use of different treatable materials must be used so that the finishing processes, including fusing, will not follow the features below and collapse the channels created. If these do not exceed the melting conditions of the top layers needed to create channels, then the multiple-channeled layer 180 will be effectively intact in the final multiple-channeled layer print 160.

Figure 6:
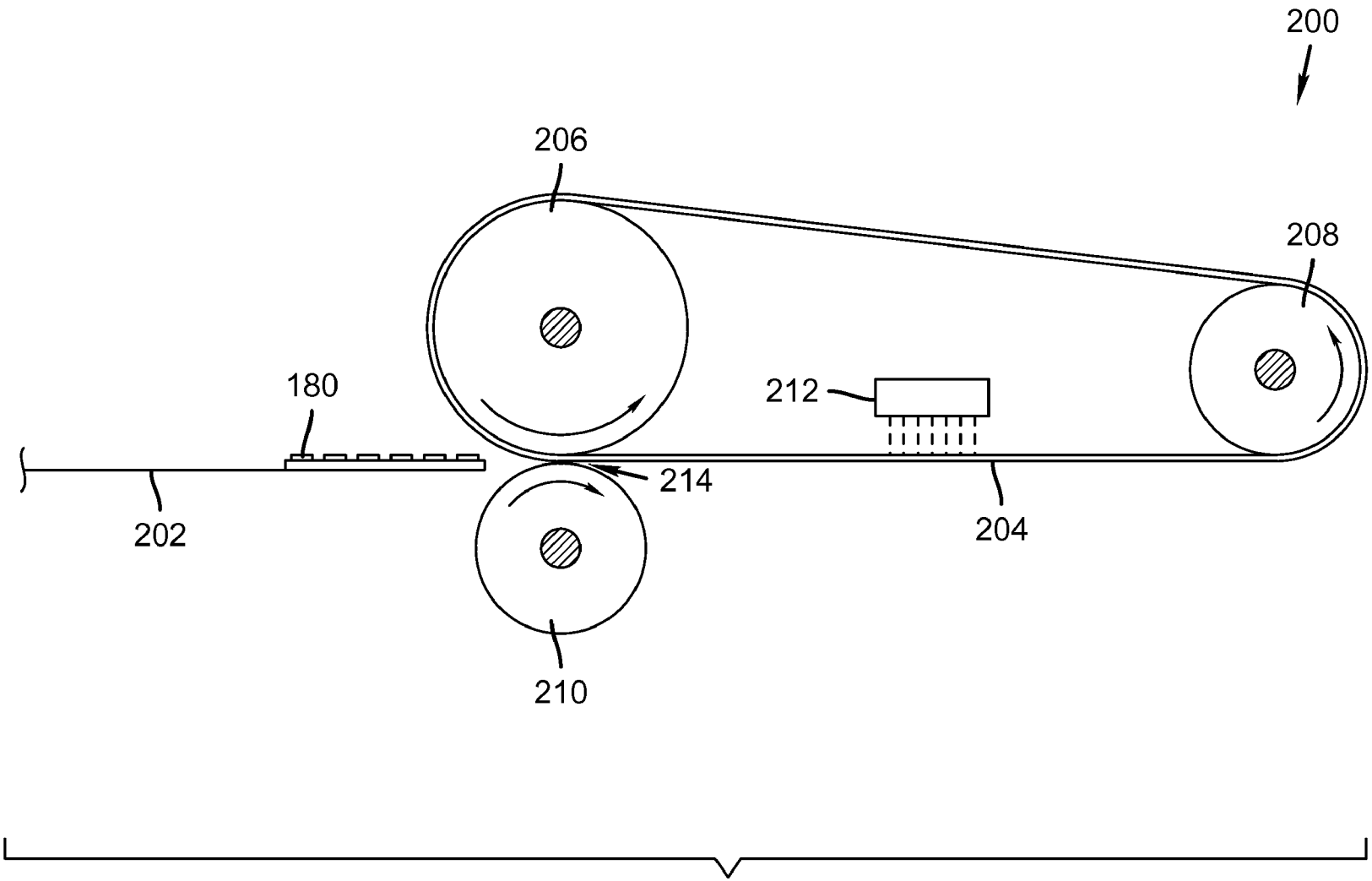
FIG. 6 is a schematic of a portion of the invention of FIG. 1.

One embodiment of the finishing assembly 102 that would allow the top layer to be applied during the fifth module is a type of finishing device 200 shown in FIG. 6. The multiple-channeled layer 180, along with one or more image layers, is transported along a path 202 to the finishing device. The finishing device includes a finishing or fusing belt 204, an optional heated glossing roller 206, a steering roller 208, and a pressure roller 210, as well as a heat shield 212.

The fusing belt 204 is entrained about glossing roller 206 and steering roller 208.

The fusing belt 204 includes a release surface of an organic/inorganic glass or polymer of low surface energy, which minimizes adherence of toner to the fusing belt 204. The release surface may be formed of a silsesquioxane, through a sol-gel process, as described for the toner fusing belt disclosed in U.S. Pat. No. 5,778,295, issued on Jul. 7, 1998, in the names of Jiann-Hsing Chen et al. Alternatively, the fusing belt release layer may be a poly (dimethylsiloxane) or a PDMS polymer of low surface energy, see in this regard the disclosure of U.S. Pat. No. 6,567,641, issued on May 20, 2003, in the names of Muhammed Aslam et al. Pressure roller 210 is opposed to, engages, and forms glossing nip 214 with heated glossing roller 206. Fusing belt 204 and the image bearing receiving member are cooled, such as, for example, by a flow of cooling air, upon exiting the glossing nip 214 in order to reduce offset of the image to the finishing belt 204. Alternately the finishing device could apply a laminate layer 184 and fuse that layer to the multiple-channeled layer 180.

The previously disclosed LCU 130 includes a microprocessor and suitable tables and control software which is executable by the LCU 130. The control software is preferably stored in memory associated with the LCU 130.

Sensors associated with the fusing and glossing assemblies provide appropriate signals to the LCU 130 when the finishing device or laminator is integrated with the printing apparatus. In any event, the finishing device or laminator can have separate controls providing control over temperature of the glossing roller and the downstream cooling of the fusing belt and control of glossing nip pressure. In response to the sensors, the LCU 130 issues command and control signals that adjust the heat and/or pressure within fusing nip 108 so as to reduce image artifacts which are attributable to and/or are the result of release fluid disposed upon and/or impregnating a receiver member that is subsequently processed by/through finishing device or laminator 200, and otherwise generally nominalizes and/or optimizes the operating parameters of the finishing assembly 102 for receiver members that are not subsequently processed by/through the finishing device or laminator 200.

The toner used to form the final multi-channeled layers can be styrenic (styrene butyl acrylate) type used in toner with a polyester toner binder. Typically the refractive index of the polymers used as toner resins have are 1.53 to almost 1.6. These are typical refractive index measurements of the polyester toner binder, as well as styrenic (styrene butyl acrylate) toner. Typically the polyesters are around 1.54 and the styrenic resins are 1.59. The conditions under which it was measured (by methods known to those skilled in the art) are at room temperature and about 590 nm. One skilled in the art would understand that other similar materials could also be used. These could include both thermoplastics such as the polyester types and the styrene acrylate types as well as PVC and polycarbonates, especially in high temperature applications such as projection assemblies. One example is an Eastman Chemical polyester-based resin sheet, Lenstar™, specifically designed for the lenticular market. Also thermosetting plastics could be used, such as the thermosetting polyester beads prepared in a PVAl stabilized suspension polymerization system from a commercial unsaturated polyester resin at the Israel Institute of Technology.

The toner used to form the final predetermined pattern is affected by the size distribution so a closely controlled size and pattern is desirable. This can be achieved through the grinding and treating of toner particles to produce various resultants sizes. This is difficult to do for the smaller particular sizes and tighter size distributions since there are a number of fines produced that must be separated out. This results in either poor distributions and/or very expensive and poorly controlled processes. An alternative is to use a limited coalescence and/or evaporative limited coalescence techniques that can control the size through stabilizing particles, such as silicon. These particles are referred to as chemically prepared dry ink (CDI) below. Some of these limited coalescence techniques are described in patents pertaining to the preparation of electrostatic toner particles because such techniques typically result in the formation of toner particles having a substantially uniform size and uniform size distribution. Representative limited coalescence processes employed in toner preparation are described in U.S. Pat. No. 4,965,131 hereby incorporated by reference. In one example a pico high viscosity toner, of the type described above, could form the first and or second layers and the top layer could be a laminate or an 8 micron clear toner in the fifth station thus the highly viscous toner would not fuse at the same temperature as the other toner.

In the limited coalescence techniques described, the judicious selection of toner additives such as charge control agents and pigments permits control of the surface roughness of toner particles by taking advantage of the aqueous organic interphase present. It is important to take into account that any toner additive employed for this purpose that is highly surface active or hydrophilic in nature may also be present at the surface of the toner particles.

Particulate and environmental factors that are important to successful results include the toner particle charge/mass ratios (it should not be too low), surface roughness, poor thermal transfer, poor electrostatic transfer, reduced pigment coverage, and environmental effects such as temperature, humidity, chemicals, radiation, and the like that affects the toner or paper. Because of their effects on the size distribution they should be controlled and kept to a normal operating range to control environmental sensitivity.

This toner also has a tensile modulus (103 psi) of 350-1020, normally 345, a flexural modulus (103 psi) of 300-500, normally 340, a hardness of M70-M72 (Rockwell), a thermal expansion of 68-70 68-70×$10^6$ μm/degree Celsius, a specific gravity of 1.2 and a slow, slight yellowing under exposure to light.

This toner also has a tensile modulus (103 psi) of 150-500, normally 345, a flexural modulus (103 psi) of 300-500, normally 340, a hardness of M70-M72 (Rockwell), a thermal expansion of 68-70 68-70×$10^6$ μm/degree Celsius, a specific gravity of 1.2 and a slow, slight yellowing under exposure to light according to J. H. DuBois and F. W. John, eds., in Plastics, 5th edition, Van Norstrand and Reinhold, 1974 (page 522).

In this particular embodiment various attributes make the use of this toner a good toner to use. In any contact fusing the speed of fusing and resident times and related pressures applied are also important to achieve the particular final desired multi-channeled layers. Contact fusing may be necessary if faster turnarounds are needed. Various finishing methods would include both contact and non-contact including heat, pressure, chemical as well as IR and UV.

The described toner normally has a melting range can be between 50-300 degrees Celsius. Surface tension, roughness and viscosity should be such as to yield a better transfer.

Surface profiles and roughness can be measured using the Federal 5000 "Surf Analyzer" and is measured in regular unites, such as microns. Toner particle size, as discussed above is also important since larger particles not only result in the desired heights and patterns but also results in a clearer multi-channeled layers since there is less air inclusions, normally, in a larger particle. Toner viscosity is measured by a Mooney viscometer, a meter that measures viscosity, and the higher viscosities will keep an multi-channeled layer's pattern better and can result in greater height. The higher viscosity toner will also result in a retained form over a longer period of time.

Melting point is often not as important of a measure as the glass transition temperature (Tg), discussed above. This range is around 50-100 degrees Celsius, often around 118 degrees Celsius. Clarity, or low haze, is important for multi-channeled layers that are transmissive or reflective wherein clarity is an indicator and haze is a measure of higher percent of transmitted light.

Another embodiment for creating the final multi-channeled layer 180 includes using a patterned paper (like an embossed paper with a specific pattern) and/or pretreated paper. Alternately a patterned roller could be used on the print prior to application of the top layer, along with a non-contact fusing, using a high MW polymer or high viscosity polymer that would not fuse like regular toner and probably a particle size much smaller than normal toner, also possibly metallic toner particles etc. Some papers, such as clay papers, actually will form a channel when heated at a higher temperature, such as during normal during fusing. The use of a clapper with clay content could be used along with a very smooth surface roller to create tiny blisters or micro spaces desired for this embodiment. The regulation of the heat and pressure would be used to control the size and shape of the multi-channels that would become the expansion spaces. Their size would be varied by the application of different amounts of heat and for different lengths of time and in conjunction with different pressures, preferably a low pressure.

In all of these approaches, a toner may be applied to form the final multi-channeled layers desired. It should be kept in mind that texture information corresponding to the toner image plane need not be binary. In other words, the quantity of clear toner called for, on a pixel by pixel basis, need not only assume either 100% coverage or 0% coverage; it may call for intermediate "gray level" quantities, as well.

It is important to be able to create channels in a digital fashion when customization is desired. This invention has the flexibility to fulfill this need. When the toner and/or laminates form the multi channel layers, with a particular paper using a primer the printer can produce a microfluidic item. In the microfluidic items the channels act as interconnects to transfer fluids between incorporated micro-devices such as pumps, devices, and sensors. The channels can also be designed to act as splitter's ports, reservoirs, filters, and separators to allow a variety of specialty micro-devices to be developed with the printer.

Figure 7:
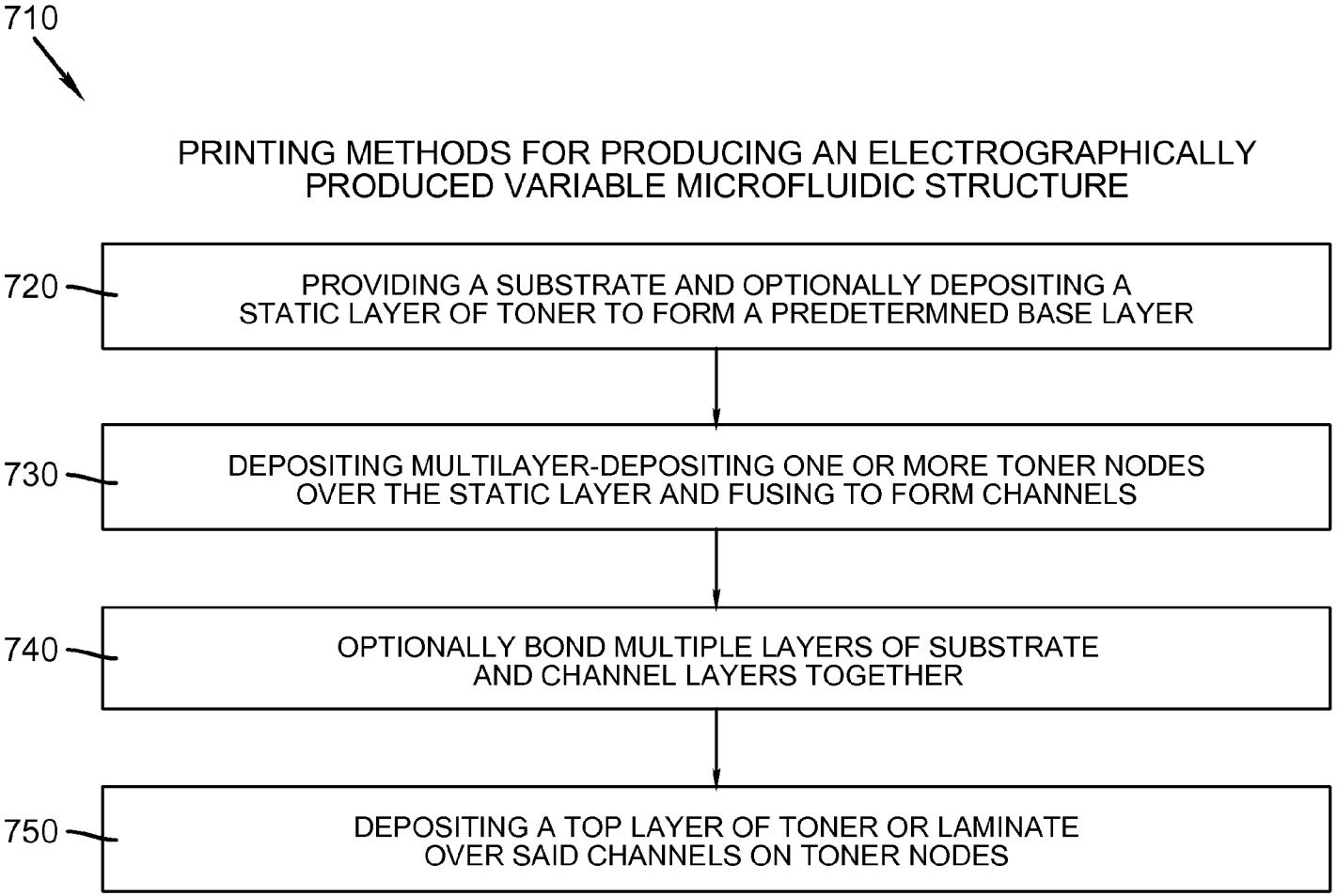
FIG. 7 is an embodiment of a digital method of printing microfluidic devices.

Referring to FIG. 7, a flow chart is shown for the printing method for producing a microfluidic device structure 710. In the first step 720 a static layer of toner is deposited to form a predetermined base layer. This step is optional if an appropriately configured substrate is provided. In step two 730, one or more layers of toner nodes are deposited over the static layer and fused to form channels. These channels can be formed in a multichannel layer defining an expansion space that includes one or more channels. In optional step three 740 the multiple layer and substrate are bonded together to form a sandwich structure. This allows crossovers or pressure valves and such to be simply formed. The structure can be bonded face to face or face to back depending on the application and device being constructed. They can also be introduced in other temporary or permanent ways.

The step three 740 can be accomplished in a number of ways. In a preferred embodiment, the faces of two samples from step 730 are heated in face contact with each other. This bonds the faces to each other and allows channels which have the ability to pass fluids between the layers.

In another preferred embodiment the back side of the substrate has an adhesive. There are also preferably holes in the substrate. The face of one substrate with the channels is adhered to the backside of another sample from step 730. The substrates may have holes to facilitate further fluid interconnects.

In step 750 a laminate or top layer cover over any exposed channels or holes is applied as an encapsulant. One embodiment of the encapsulant is as a laminate. The laminate can be any material which does not interact with the solvent and can be adhered to the tops of the channels. It can include a thermal adhesive or a pressure sensitive adhesive or simple be directly fusable with the channel.

Figure 8:
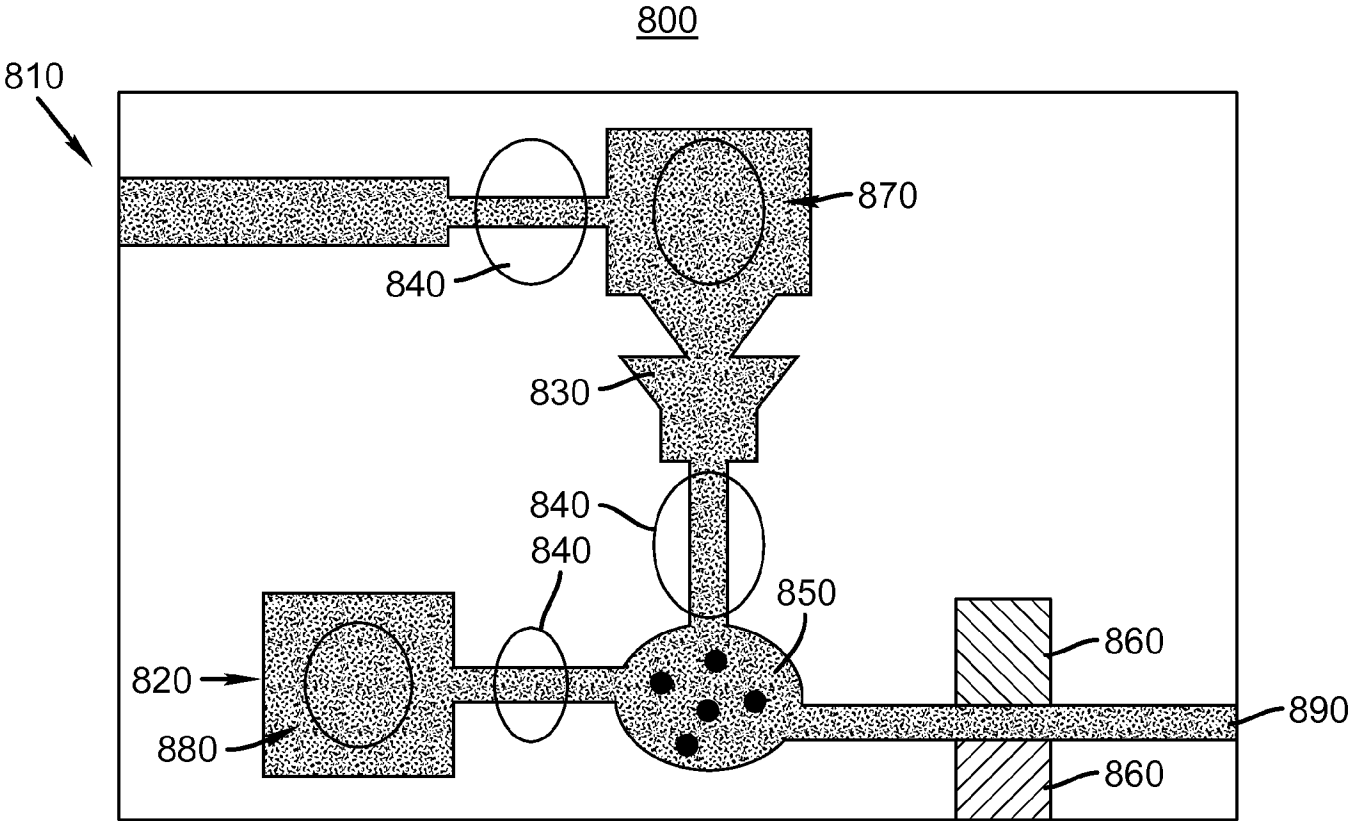
FIG. 8 shows a top view of one embodiment of a microfluidic device formed using the present invention.

Referring to FIG. 8 we show a top view of an example embodiment of microfluidic device 800. In this device there are numerous functional parts. The fluid is introduced at the inlet port 810. This inlet can be just a tube applied, a needle insertion or something more complicated such as a tubing quick disconnect. Note that this method is described for a fluid, but it could also use a movable material which is not a fluid, but acts as a fluid.

The fluid passes through a pressure valve 840. This pressure valve can be used to hold the fluid from back-flowing out of the device or to stop more fluid from entering the device. The pressure valve operates by and is activated by pressure. Pressure is applied over the top layer over the channel, deforming the top layer. The region is represented by the circle in the figure. This deformation is increased until the channel is pinched off. The pressure can be pneumatic, hydraulic, mechanical or any other known method for applying pressure.

The fluid then enters a pressure pump 870. The operation of the pressure pump is similar to the pressure valve 840. Pressure is applied to the top layer over the fluid chamber, again represented by a circle, which pushes the fluid under the deformed top layer out. This results in increased pressure which causes the fluid to move into the directional flow device 830.

The purpose of the directional flow device 830 is to act as a flow diode. Most of the flow goes forward since it is expanding into a larger region but when pressure is released only slowly return the other direction. By alternately applying pressure to pressure pump 870, fluid can be moved along. The use of pressure valves on either side can also be used to increase efficiency by only allowing fluid in or out at the appropriate time in the cycle.

After passing out of the directional flow device 830 and through another pressure valve 840 the fluid passes into a mixing chamber 850. Attached to the mixing chamber is a reservoir 820. The reservoir can have pressure applied to deform the top layer as depicted by the circle 880 and force fluid out through the open pressure valve 840 into the mixing chamber 850. The mixing chamber 850 can have many design shapes. The main consideration is to prevent laminar flow and induce mixing chaotically. When properly designed, the flow of the fluids will wind around and circulate to give adequate mixing.

The fluid then flows between emitter/detectors sensor combination 860. An example emitter is an LED diode emitter and a phototransistor to monitor the optical absorption of the fluid as it passes through. The emitter and detector can be placed embedded in the microfluidic device or the light can be waveguided to on from the detector/emitter as detailed in co-pending application U.S. Ser. No. 12/608,047. The fluid then is exhausted through the exit port 890.

Figure 9:
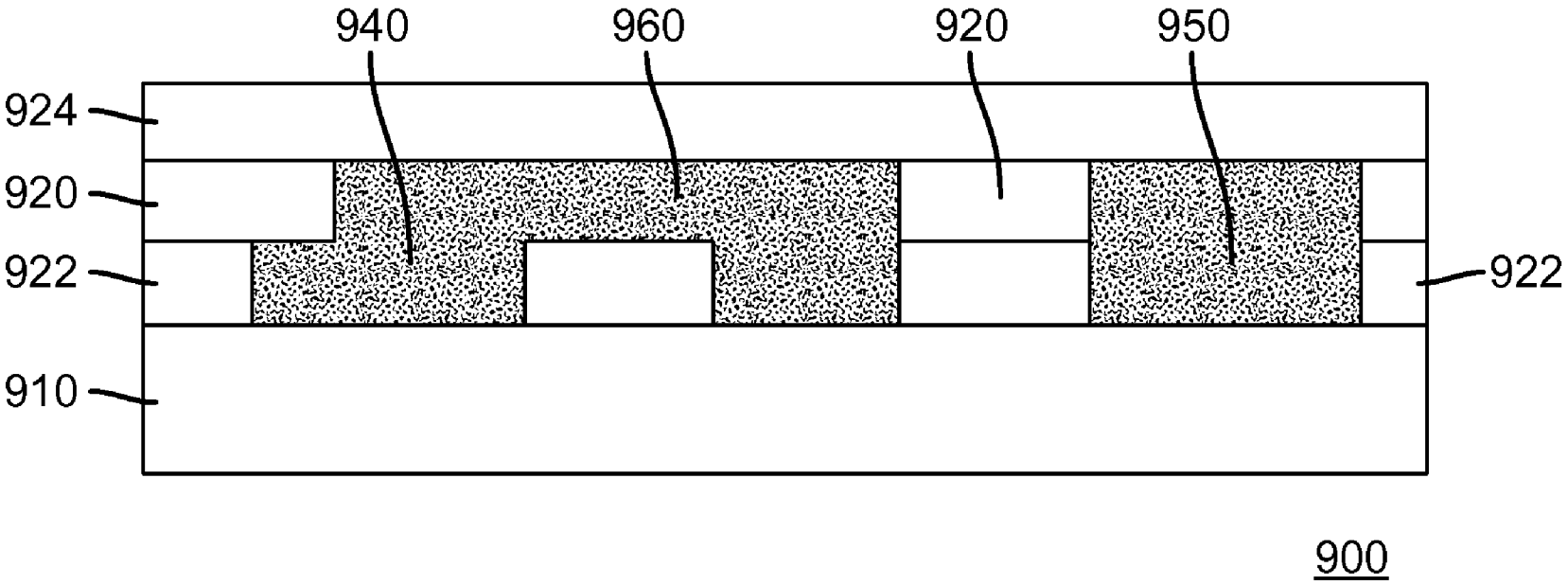
FIG. 9 shows a cross section of another embodiment of the microfluidic device.
Figure 10:
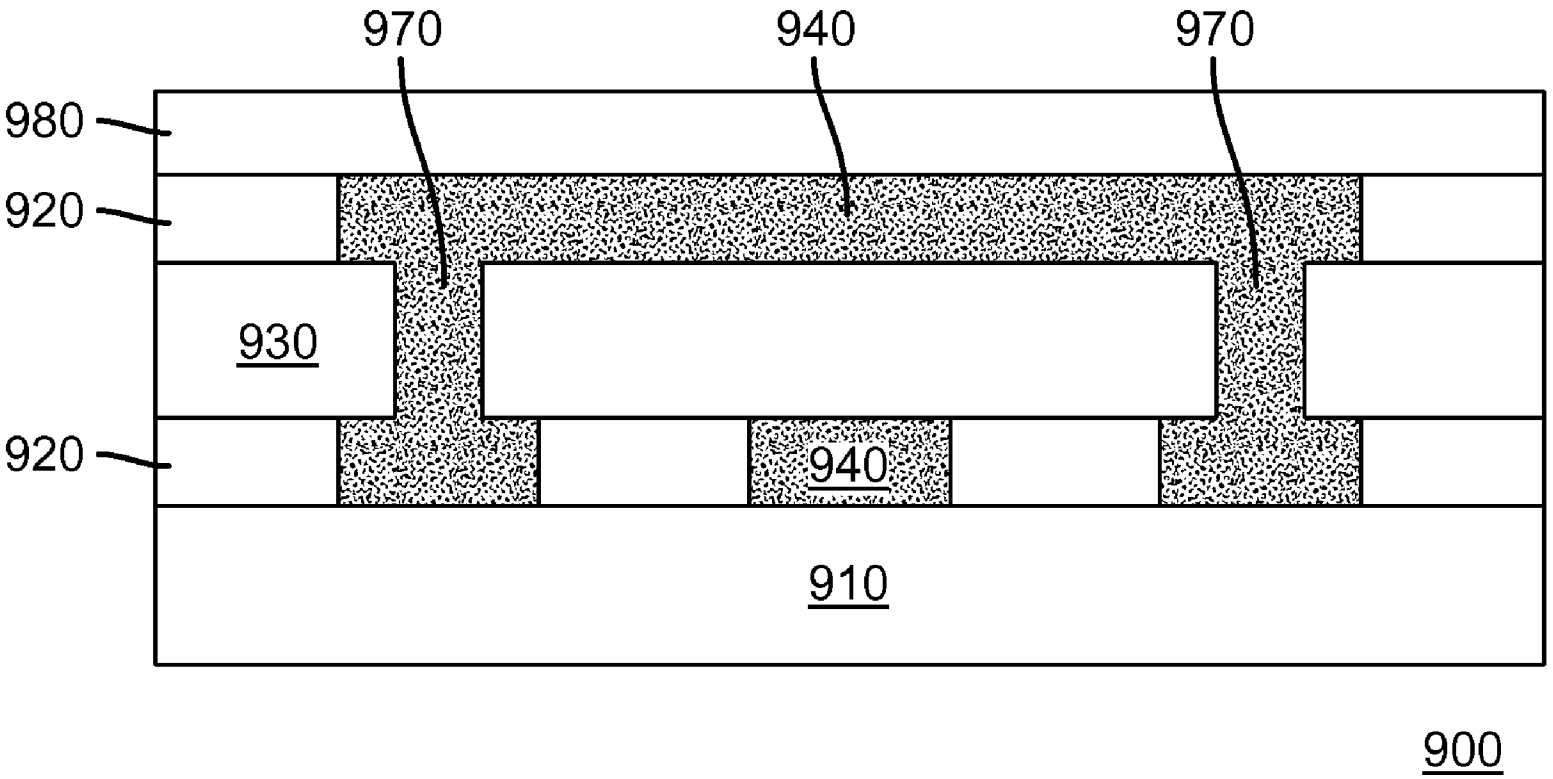
FIG. 10 shows a cross section of another embodiment of the microfluidic device.

FIGS. 9 and 10 show the cross sectional views of two embodiments, two microfluidic devices and also show how they are assembled or printed according to this invention. In FIG. 9 the microfluidic device 900 is formed on a substrate 910 by applying toner as nodes 920 over a first layer of toner 922 electrophotographically to create a multi channel patterns having one or more channels 940 which can be overlaid with a cover, such as a laminate 924. Alternatively, only one layer of toner is laid down to create nodes 920 and a second substrate with toner nodes 920 and channels 940 is generated with a different pattern of the channels. The two substrates with channels are attached face to face to each other. The attachment can be though lamination or an adhesive to give the resulting microfluidic device 900 as shown. Where the channels 940 coincide more fluid can be held and large areas can serve as reservoirs 950. These reservoirs can also contain material, such as particulate material. Thin regions such as valve pressure region 960 can be used as a valve when pressure is applied to the substrate above it. Note that this process can be repeated to create many layered microfluidic devices.

A second embodiment of a microfluidic device 900 manufactured or printed according to this invention is shown in FIG. 10. In this embodiment toner nodes 920 are applied electrophotographically to substrate 910 to create channels 940 as described above. A second substrate 930 is used which has holes 970 through it. Toner nodes are again applied to form channels 940 in a two-step printing process as described above or by attaching the back of substrate 930 to the first substrate and toner nodes by any known means such as lamination and/or adhesion. Finally a top encapsulant layer 980 is applied. This top encapsulant may be a laminate or other top layer. Note that this process as well as all those described above, can be repeated may times to create a multi-layered microfluidic device.

The substrate with holes 930 maybe generated with the holes just where needed. This can be accomplished by drilling, laser ablation or any other removal process that allows accurate placement of holes. The holes must then be aligned during the lamination. Another method for generating the desired pattern of holes in a substrate is to provide a substrate with a regular array of holes and then fill in the undesired holes. This embodiment is very compatible with this process as the substrate can be generated with little concern for the final design of holes and then the electrophotographic deposition is used to pattern a non-permeable base over the undesired holes. Some methods for generating a regular array for small holes is through extrusion onto a form as well as direct perforations.

The embodiment shown in FIG. 10 also has channel crossovers. These allow fluids to be moved over the top of another fluid and/or to be kept separate. This can be combined with devices shown in the previous figures to yield a vast array of individually configurable devices. Since they can be individually changed "on the fly" it is even possible to put in minor changes from one device to the next if desired, i.e. personalizable. Examples of the sort of products that could be formed using microfluidic devices including 2 part electro-luminescent chemicals such as the light stick type where chemicals are mixed with the ability to glow when activated, such as cracking or pressing on the microfluidic device. Other products produced with this invention incorporate expanding materials, such as Expancel™, for example the incorporation of expanding microspheres into the channels and the voids increases paper weight to create variable weight paper. Similarly hygroscopic materials can be introduced to create microfluidic items that absorb moisture or pharmaceuticals. These products can be combined with other additions that include colors and indicators such as to create tell-tale labels. One example would be to analyze an organic or inorganic sample and indicate the presence of certain material, such as with a Ph test. The voids and reservoirs can also have resins introduced that later harden.

Other uses are any microdevice that needs micropumps and reservoirs that could be as small as capillaries. The same capillary pressures allow these microfluidic devices to be so small they could be used in both organic and non-organic applications. The optional permeable layers with "holes" can function as membranes that allow some ions to flow and others to be blocked. By mimicking human and plant functions in organic applications many application like biomass generation and membrane filtering, can be done.

These applications include the possibility of pumping and mixing 2 materials allow the manufacture of batteries, solar cells, and/or capacitors. Once again the "holes" can act like barriers to some ions that do not move through the layer or "membrane".

The application of charges can further help and things like electronic paper and filtering can be accomplished. Various reactants and indicators can also be introduced as needed. Another application is electrochemistry such as to deposit metals.

The invention has been described in detail with particular reference to certain preferred embodiments thereof, but it will be understood that variations and modifications can be effected within the spirit and scope of the invention.

What is claimed is:

1. A printing method of manufacturing a microfluidic structure comprising:

a. depositing a static layer of toner to form a predetermined multi-channeled layer;

b. depositing a second layer of one or more toner nodes over the static layer;

c. depositing a top layer over said toner nodes, said top layer and the multi-channeled layer defining a void space adjacent said toner nodes;

d. providing one or more barrier regions in one or more channels defined by the multi-channeled layer; and e. using said barrier regions and said void spaces to create micro-fluidic action to move a fluid in the one or more channels where a pressure is used to deform the one or more channels to create one or more barriers in a barrier region in the multi-channeled layer.

2. The method of claim 1, wherein said one or more barriers act as a total barrier to the flow of the fluid in the one or more channels.

3. The method of claim 1, wherein said one or more barriers act as a restriction to the flow of the fluid in the one or more channels.

4. The method of claim 1 wherein the top layer is one of a laminate or an inverted multichannel layer, further comprising an adhesion portion to join to one or more of the toner nodes.

5. The method of claim 1 further comprises activating the fluid in the one or more channels having barrier regions to create fluid movement.

6. The method of claim 5 wherein the fluid movement creates one or more of the following: pump, pressure valve, filter, crossovers, encapsulate, flow diode, tubing, motor, electronic device, storage device, mixing chamber, indicator, sensor, emitter, detector, waveguide, splitter port, reservoir, separator, expansion mechanism, and personalized item.

7. The method of claim 6 further creating one or more of the following: resultant pharmaceutical, expanded material, electrical circuit, solar cell, storage battery, osmotic filter, adsorptive device, absorptive device, electro-luminescence device, medical measurement device or indicator, mixture, and new material formed from two or more chemicals.

8. A printing method of manufacturing a microfluidic structure comprising:

a. depositing a static layer of toner to form a predetermined multi-channeled layer;
b. depositing a second layer of one or more toner nodes over the static layer;
c. depositing a top layer over said toner nodes, said top layer and the multi-channeled layer defining a void space adjacent said toner nodes;
d. providing one or more barrier regions in one or more channels defined by the multi-channeled layer; and
e. using said barrier regions and said void spaces to create micro-fluidic action to move a fluid in the one or more channels wherein the one or more layers have one or more holes.

9. A method for electrographic printing of a microfluidic structure upon a receiver, said printing comprising the steps of:

a. depositing a static layer of toner to form a predetermined multi-channeled layer;
b. depositing a second layer of one or more toner nodes over the static layer;
c. depositing a top layer over said toner nodes, said top layer and the multi-channeled layer defining a void space adjacent said toner nodes;
d. providing one or more barrier regions in one or more channels defined by the multi-channeled layer; and
e. fusing the top layer and said multi-channeled layer so that the barrier regions and the void spaces work together to create micro-fluidic action capable of moving a fluid in the one or more channels where a pressure is used to deform the one or more channels to create one or more barriers in a barrier region in the multi-channeled layer.

10. The method of claim 9, wherein said one or more barriers act as a total barrier to the flow of the fluid in the one or more channels.

11. The method of claim 9, wherein said one or more barriers act as a restriction to the flow of the fluid in the one or more channels.

12. A method for electrographic printing of a microfluidic structure upon a receiver, said printing comprising the steps of:

a. depositing a static layer of toner to form a predetermined multi-channeled layer;
b. depositing a second layer of one or more toner nodes over the static layer;
c. depositing a top layer over said toner nodes, said top layer and the multi-channeled layer defining a void space adjacent said toner nodes;
d. providing one or more barrier regions in one or more channels defined by the multi-channeled layer; and
e. fusing the top layer and said multi-channeled layer so that the barrier regions and the void spaces work together to create micro-fluidic action capable of moving a fluid in the one or more channels wherein the one or more layers have one or more holes.

13. The method of claim 12 wherein the top layer is one of a laminate or an inverted multichannel layer, further comprising an adhesion portion to join to one or more of the toner nodes.

14. The method of claim 12 further comprises activating the fluid in the one or more channels having barrier regions to create fluid movement.

15. The method of claim 14 wherein the fluid movement creates one or more of the following: pump, pressure valve, filter, crossovers, encapsulate, flow diode, tubing, motor, electronic device, storage device, mixing chamber, indicator, sensor, emitter, detector, waveguide, splitter port, reservoir, separator, expansion mechanism, and personalized item.

16. An apparatus for producing a microfluidic structure, the apparatus comprising:

a. an imaging member;
b. a development station for depositing two or more layers of toner by depositing a static layer of toner to form a predetermined multi-channeled layer and depositing a second layer of one or more toner nodes over the static layer creating one or more channels and barrier regions;
c. a lamination application device to apply a top layer of laminate over the one or more channels and barrier regions;
d. a controller for controlling filling the one or more channels with one or more materials; and
e. an activator for moving the one or more materials further comprising a pumping one material to interact with another material in the one or more channels.

17. The apparatus according to claim 16 wherein the top layer is one of a laminate or an inverted multichannel layer, further comprising an adhesion portion to join to one or more of the toner nodes.

18. The apparatus according to claim 16 further comprises activating the fluid in the one or more channels having barrier regions to create fluid movement.

19. The apparatus according to claim 16 wherein the fluid movement creates one or more of the following: pump, pressure valve, filter, crossovers, encapsulate, flow diode, tubing, motor, electronic device, storage device, mixing chamber, indicator, sensor, emitter, detector, waveguide, splitter port, reservoir, separator, expansion mechanism, and personalized item.

20. An apparatus for producing a microfluidic structure, the apparatus comprising:

a. an imaging member;
b. a development station for depositing two or more layers of toner by depositing a static layer of toner to form a predetermined multi-channeled layer and depositing a second layer of one or more toner nodes over the static layer creating one or more channels and barrier regions;
c. a lamination application device to apply a top layer of laminate over the one or more channels and barrier regions;
d. a controller for controlling filling the one or more channels with one or more materials; and
e. an activator for moving the one or more materials further comprising a device to create holes in one or more layers.

21. The apparatus according to claim 20 further comprising a fusing device that fuses using ultraviolet or infrared energy.

22. The apparatus according to claim 20 wherein the apparatus is multi stationed.

* * * * *